US006407705B1

(12) United States Patent
Sanad

(10) Patent No.: US 6,407,705 B1
(45) Date of Patent: Jun. 18, 2002

(54) COMPACT BROADBAND HIGH EFFICIENCY MICROSTRIP ANTENNA FOR WIRELESS MODEMS

(76) Inventor: Mohamed Said Sanad, 5830 Lindsay Dr., Reno, NV (US) 89523

( * ) Notice: Subject to any disclaimer, the term of this patent is extended or adjusted under 35 U.S.C. 154(b) by 0 days.

(21) Appl. No.: 09/605,047

(22) Filed: Jun. 27, 2000

(51) Int. Cl.[7] ..... H01Q 1/38
(52) U.S. Cl. ..... 343/700 MS; 343/702
(58) Field of Search ..... 343/700 MS, 702; H01Q 1/58

(56) References Cited

U.S. PATENT DOCUMENTS

| | | | | | |
|---|---|---|---|---|---|
| 3,978,487 | A | * | 8/1976 | Kaloi | 343/829 |
| 4,370,657 | A | * | 1/1983 | Kaloi | 343/700 MS |
| 4,761,654 | A | * | 8/1988 | Zaghloul | 343/700 MS |
| 4,812,855 | A | * | 3/1989 | Coe et al. | 343/818 |
| 5,627,550 | A | * | 5/1997 | Sanad | 343/700 MS |
| 5,955,994 | A | * | 9/1999 | Staker et al. | 343/700 MS |

OTHER PUBLICATIONS

C.K. Aanadan and K.G. Nair; "Compact Broadband Microstrip Antenna"*Electronics Letters*, vol. 22(20) pp. 1064–1065; Sep. 25, 1986.*

Keith R. Carver and James W. Mink; "Microstrip Antenna Technology" *IEEE Transactions on Antennas and Propagation*, vol. AP–29(1) Jan. 19981.*

J. P. Damiano, et al. "Study of multilayer microstrip antennas with radiating elements of various geometry" *IEE Proceedings*, vol. 137.Pt. H. (3) pp.163–170, Jun. 1990.*

Gert F. Pedersen and Jorgen B. Andersen; "Intergrated Antennas for Hand–held Telephones with Low Absorption", *IEEE* vol. 3, pp. 1537–1541 (1994).*

Mohamed Sanad; "A small size microstrip antenna having a partial short circuit" *IEE Ninth International Conference on Antennas and Propagation* (Conf. Publ. No. 407) vol. 1, pp. 282–285 (1995).*

* cited by examiner

*Primary Examiner*—Michael C. Wimer
(74) *Attorney, Agent, or Firm*—Townsend and Townsend and Crew LLP

(57) ABSTRACT

An antenna structure includes a ground plane, a layer of dielectric material having a first surface overlying the ground plane and an opposing second surface, and an electrically conductive layer overlying the second opposing surface of the dielectric layer. The electrically conductive layer is differentiated into a plurality of antenna elements including a driven antenna element and first and second non-driven, parasitic antenna elements. Each of the elements has a shape of a parallelogram having parallel first edges of length L and parallel second edges of length W, wherein one of the first edges of the first parasitic element is disposed substantially along one of the first edges of the driven element at a gap width $W_G$, and wherein one of the first edges of the second parasitic element is disposed substantially along the opposite one of the first edges of the driven element at the gap width $W_G$. Each of the antenna elements includes means for shorting the electrically conductive layer to the ground plane at a region proximate to one of the second edges of the electrically conductive layer. Also, each of the antenna elements has a resonant frequency, wherein the resonant frequencies are varied from each other using only the means for shorting. The antenna structure further includes means for coupling radio frequency energy to the driven antenna element of the electrically conductive layer.

32 Claims, 4 Drawing Sheets

COMPACT BROADBAND HIGH EFFICIENCY MICROSTRIP ANTENNA FOR WIRELESS MODEMS

BACKGROUND OF THE INVENTION

The present invention relates to small microstrip antennas for use in electronic devices. Particularly, the invention relates to efficient and compact microstrip antennas comprising a plurality of patches.

Advances in digital and radio electronics have resulted in the production of a new breed of personal communications equipment posing special problems for antenna designers. As users demand smaller and more portable communications equipment, antenna designers are pressed to provide smaller profile antennas. Additionally, users of such communications equipment desire high data throughput, thus requiring antennas with wide bandwidths and isotropic radiation patterns. Moreover, antennas in such portable equipment are often randomly oriented during use, or used in environments, such as urban areas and inside buildings, that are subject to multipath reflections and rotation of polarization. Thus, an antenna in such devices should be sensitive to both horizontally and vertically polarized waves.

Wire antennas, such as whips and helical antennas are sensitive to only one polarization. As a result, they are not optimal for use in portable communication devices. One solution is to utilize microstrip patch antennas. In general, microstrip antennas are known for their advantages in terms of light weight, flat profiles, and compatibility with integrated circuits. A microstrip patch antenna comprises a dielectric sandwiched between a conductive ground plane and a planar radiating patch. Thus, microstrip patch antennas are useful alternatives for applications requiring a small and particularly thin overall size.

Microstrip patch antennas are commonly produced in half wavelength sizes, in which there are two primary radiating edges parallel to one another. It is known that the size may be further reduced if all of one of the primary radiating edges of a microstrip patch antenna is short circuited, permitting the size of the radiating patch to be reduced to a quarter wavelength. Additionally, it is known that the size may be reduced even further, to approximately one third the size of a half-wavelength antenna, if one of the primary radiating edges is partially shorted circuited. The short circuit is typically created by wrapping a thin sheet of copper foil to electrically connect the ground plane to the radiating patch. To simplify the manufacture of these antennas, shorting posts have been used in lieu of copper foil.

However, microstrip patch antennas are resonant structures with a relatively small bandwidth of operation and, therefore, are not optimal for wide bandwidth applications, such as data communications. It is known to improve the bandwidth of a rectangular patch antenna by placing non-driven, parasitic, patches parallel to the nonradiating edges of the driven patch. For example, U.S. Pat. No. 5,955,994 discloses a rectangular, half-wavelength microstrip patch antenna flanked at both non-radiating edges by identically shaped parasitic patches. However, this antenna is of a relatively large size.

In order to further improve the bandwidth of a rectangular patch antenna with parasitic patches, the shapes of the parasitic patches may be changed from that of the driven patch. For example, Keith Carver & James Mink, Microstrip Antenna Technology, I.E.E.E. AP-29 Trans. on Antennas and Propagation 2, 13–14 (Jan. 1981) discloses a square patch antenna having parasitic patches with smaller widths and longer lengths than the driven patch. The bandwidth may also be improved by spacing each parasitic patch at a different gap width from the driven patch.

However, these parasitic microstrip patch antennas have several drawbacks. For instance, the efficiency of such antennas may differ significantly with frequency within the resonant frequency range, and the antennas often have a reduced overall efficiency. Also, these antennas often have a highly asymmetric radiation pattern.

It would be desirable to provide a microstrip patch antenna with greater bandwidth as well as an efficiency symmetric with frequency. It would also be desirable to provide such a broadband microstrip antenna with a symmetric radiation pattern.

SUMMARY OF THE INVENTION

According to the invention, an antenna structure is provided. The antenna structure includes a ground plane, a layer of dielectric material having a first surface overlying said ground plane and an opposing second surface, and an electrically conductive layer overlying said second opposing surface of said dielectric layer. The electrically conductive layer is differentiated into a plurality of antenna elements including a driven antenna element and first and second non-driven, parasitic antenna elements. Each of said elements has a shape of a parallelogram having parallel first edges of length L and parallel second edges of length W, wherein one of said first edges of said first parasitic element is disposed substantially along one of said first edges of said driven element at a gap width $W_G$, and wherein one of said first edges of said second parasitic element is disposed substantially along the opposite one of said first edges of said driven element at said gap width $W_G$. Each of said antenna elements includes means for shorting said electrically conductive layer to said ground plane at a region proximate to one of said second edges of said electrically conductive layer. Also, each of said antenna elements has a resonant frequency, wherein said resonant frequencies are varied from each other using only said means for shorting. The antenna structure further includes means for coupling radio frequency energy to said driven antenna element of said electrically conductive layer.

The antenna structure according to the invention provides improvements in the symmetry of the antenna's efficiency and radiation pattern because the shape of the antenna elements are substantially the same and the gap widths between the elements are substantially the same. The resonant frequencies of the elements are varied from each other using only the means for shorting.

DESCRIPTION OF THE SPECIFIC EMBODIMENTS

Figure 1:
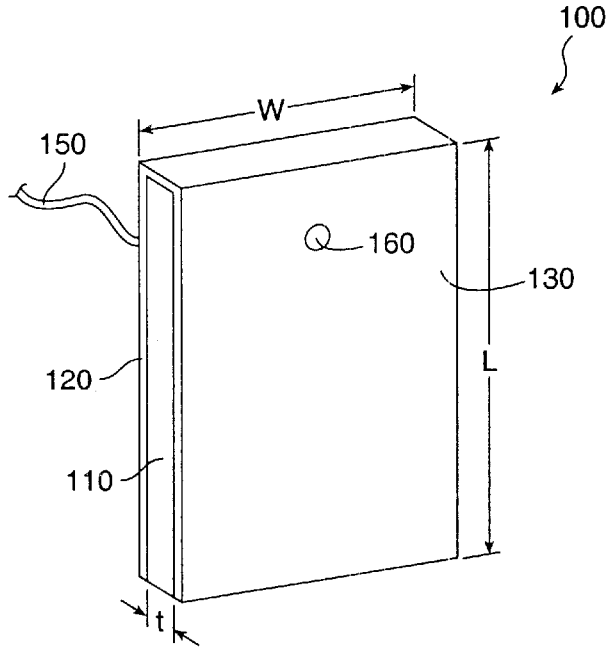
FIG. 1 (PRIOR ART)
FIG. 1 is a perspective view of a typical quarter wavelength microstrip antenna.

FIG. 1 shows a typical quarter wavelength microstrip antenna 100. The antenna includes a dielectric layer 110 sandwiched between a conductive ground plane 120 and a conductive radiating patch 130. The radiating patch 130 is energized by a connection through a coaxial cable 150 to feed point 160. In microstrip antennas of this type, the length L and the width W of the radiating patch 130 are adjusted in a manner well known to those skilled in the art to achieve a desired resonant frequency.

FIGS. 2–4, and 6 illustrate exemplary wideband microstrip antennas according to the present invention. The invention provides a microstrip antenna with a greater bandwidth than is achievable with a typical quarter wavelength microstrip antenna such as that shown in FIG. 1. It is to be understood that the dimensions given have been selected to describe representative embodiments of antennas that operate at specific resonant frequencies. Additionally, it is to be understood that, for given desired resonant frequencies, different dimensions may result in better performance depending on parameters such as the location of the antenna in its end use and the like. Upon reading this specification, those skilled in the art will recognize that the technique of the present invention may be applied to a variety of antenna sizes in order to achieve a wide range of performance characteristics. In general, the present invention may be implemented on different size antennas by scaling the dimensions discussed herein.

Figure 2:
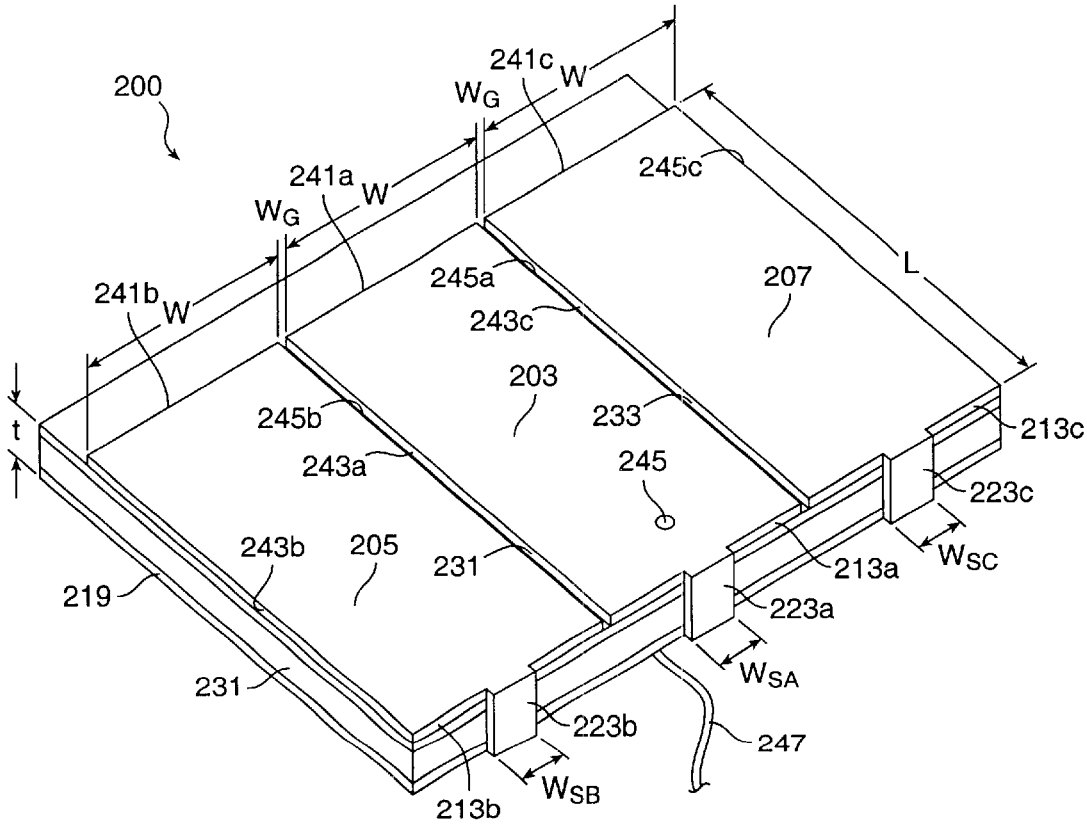
FIG. 2 is a perspective view of an embodiment of an antenna according to the invention.

FIG. 2 illustrates one embodiment of the present invention. An antenna 200 includes three radiating elements: a driven element 203, and two parasitic elements 205 and 207. Each of the radiating elements 203, 205, and 207 has the shape of a rectangle, and has substantially the same length L and width W. The radiating elements 203, 205, and 207 are each partially shorted, at shorted edges 213*a,* 213*b,* and 213*c,* respectively, to a conductive ground plane 219 via short circuits 223*a,* 223*b,* and 223*c,* respectively. A dielectric layer 231 is sandwiched between the radiating elements 203, 205, and 207 and the ground plane 219. Parasitic elements 205 and 207 are separated from the driven element 203 by gaps 231 and 233, each of width $W_G$. Although two parasitic elements are illustrated, it is within the scope of the invention to use one parasitic element, or to use more than two parasitic elements.

In the present invention, the resonant frequencies of the respective radiating elements 203, 205, and 207 are varied from each other only by varying the characteristics of the respective short circuits 223*a,* 223*b,* and 223*c,* while keeping the shapes of the elements and the width of the gaps between them substantially the same. It has been found that varying the characteristics of the short circuits 223*a,* 223*b,* and 223*c* has minimal effects on the efficiencies of the respective radiating elements. Therefore, because the shapes of the radiating elements 203, 205, and 207 are substantially the same, and the widths of the gaps 231 and 233 are substantially the same, the respective efficiencies of the radiating elements are also substantially the same. This results in an antenna with an efficiency having improved symmetry across its bandwidth of operation, and with a more highly symmetric radiation pattern.

Positioned opposite the shorted edges 213*a,* 213*b,* and 213*c* are the primary radiating edges 241*a,* 241*b,* and 241*c,* respectively. The elements 203, 205, and 207 each also include side edges 243*a* and 245*a,* 243*b* and 245*b,* and 243*c* and 245*c,* respectively. Those skilled in the art will appreciate that while edges 241*a,* 241*b,* and 241*c* are termed the "primary" radiating edges, some lesser amounts of radiation will be generated from each of the other edges of the elements 203, 205, and 207. The primary radiating edges 241*a,* 241*b,* and 241*c,* and the side edges 243*a* and 245*a,* 243*b* and 245*b,* and 243*c* and 245*c* are each open circuited along their entire lengths. The short circuits 223*a,* 223*b,* and 223*c* may be created by, for example, wrapping a thin sheet of copper foil to electrically connect each of the elements to the ground plane 219. The short circuits may be created by using other conductors such as, for example, electrically conductive tape, a shorting bar, shorting posts, and the like. The short circuits 223*a,* 223*b,* and 223*c* have widths of $W_{SA}$, $W_{SB}$, and $W_{SC}$, respectively.

A feed point 245 is positioned proximate to the shorted edge 213*a* of driven element 203 and substantially equidistant between the edges 243*a* and 245*a*. In a specific embodiment, the feed point 245 is coupled to a conventional coaxial cable 247. In particular, a center conductor of the coaxial cable 247 is coupled to the driven element 203 at the feedpoint 245, and an outer conductor of the coaxial cable is coupled to the ground plane 219. Other types of feed schemes known to those skilled in the art may also be employed, such as microstrip feeds and the like. In this manner, the driven patch 203 is driven by the coaxial cable 247, and the parasitic patches 205 and 207 are parasitically coupled to the driven patch 203 across gaps 231 and 233.

It has been found that if the partial short circuits of the elements 203, 205, and 207 are made different, a relatively wide bandwidth microstrip antenna may be achieved even if the shapes of the parasitic elements 205 and 207 remain substantially the same as the driven element 203, and even if the gaps 231 and 233 between the elements are substantially the same. Additionally, it has been found that such an antenna has a high overall efficiency, an efficiency that is highly constant over the whole of the resonant frequency band, and a more symmetric radiation pattern.

The wideband microstrip antenna 200 has a number of parameters that can be designed to optimize characteristics of the antenna. For example, the length L of the radiating elements 203, 205, and 207 in conjunction with each of the widths of the short circuits $W_{SA}$, $W_{SB}$, and $W_{SC}$ may be adjusted to obtain resonant frequencies for each of the elements 203, 205, and 207 in a manner well known to those skilled in the art (i.e. increasing L decreases the resonant frequency, while increasing a short circuit width increases the resonant frequency). Additionally, increasing the gap width $W_G$ generally increases the bandwidth. But, increasing the gap width $W_G$ eventually will adversely affect the coupling between the driven element 203 and the parasitic elements 205 and 207.

Moreover, the position of the feedpoint 245, in conjunction with the widths of the short circuits $W_{SA}$, $W_{SB}$, and $W_{SC}$, may be adjusted to achieve a desired input impedance. In general, in order to satisfy an input impedance of 50 ohms, the feedpoint 245 should be moved closer to the shorted edge 213*a* as the width $W_{SA}$ of the short circuit decreases. However, the width of the short circuit may only be reduced to a minimum value, below which performance of the antenna is affected. Antenna performance is adversely affected when the feedpoint 245 is located too close to the short circuit 223*a*. For instance, if the width of short circuit 223*a* is reduced to a point requiring the feedpoint 245 to be located too close to the shorted edge of 213*a,* a parasitic current might be induced on the outer conductor of the coaxial cable 247. Additionally, if the width of a short circuit 223*a* is reduced too much, it may be impossible to locate feedpoint 245 in order to achieve an input impedance of 50 ohms.

Figure 3:
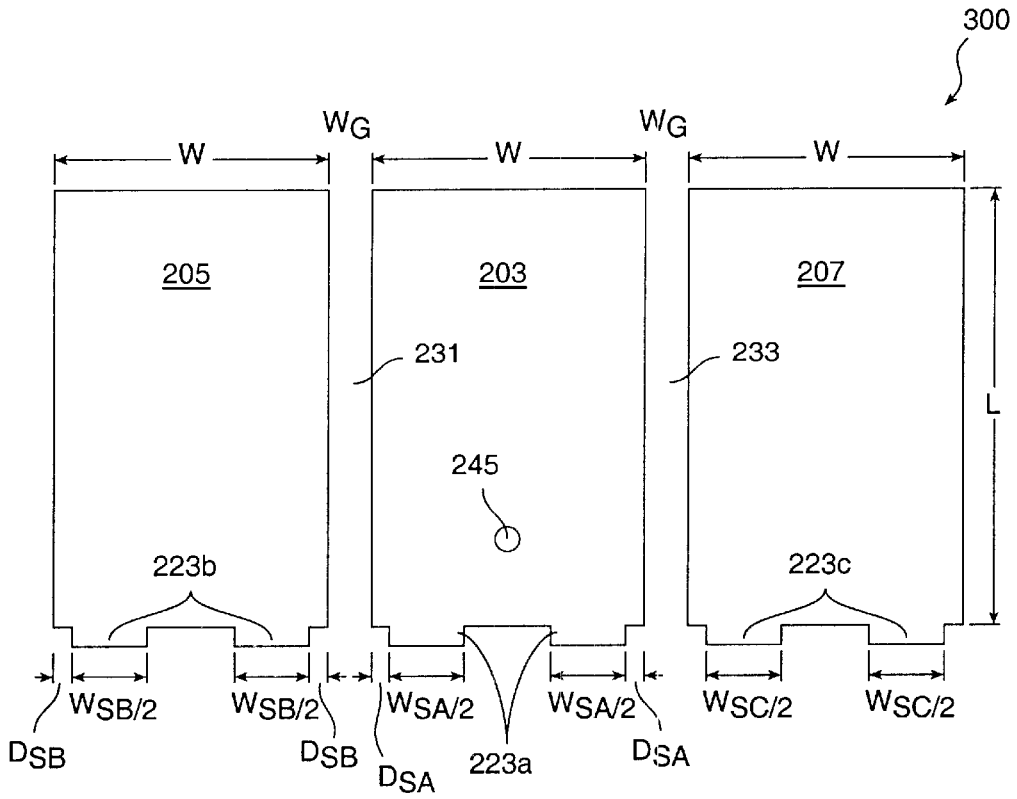
FIG. 3 is a top view of another embodiment of an antenna according to the invention.

FIG. 3 illustrates an antenna according to another embodiment of the invention that alleviates some of the above-mentioned limitations. FIG. 3 is a top view of the driven and parasitic antenna elements of an antenna 300 in which each of the short circuits is comprised of two sections having equal widths. For instance, short circuit 223*a* is comprised of two separate sections, each of width $W_{SA}/2$. Each section of short circuit 223*a* is located a distance $D_{SA}$ from a respective side edge of the antenna element 203. The short circuit configuration shown in FIG. 3 acts to improve the spacing between the feedpoint 245 and the short circuit 223*a*.

Figure 4:
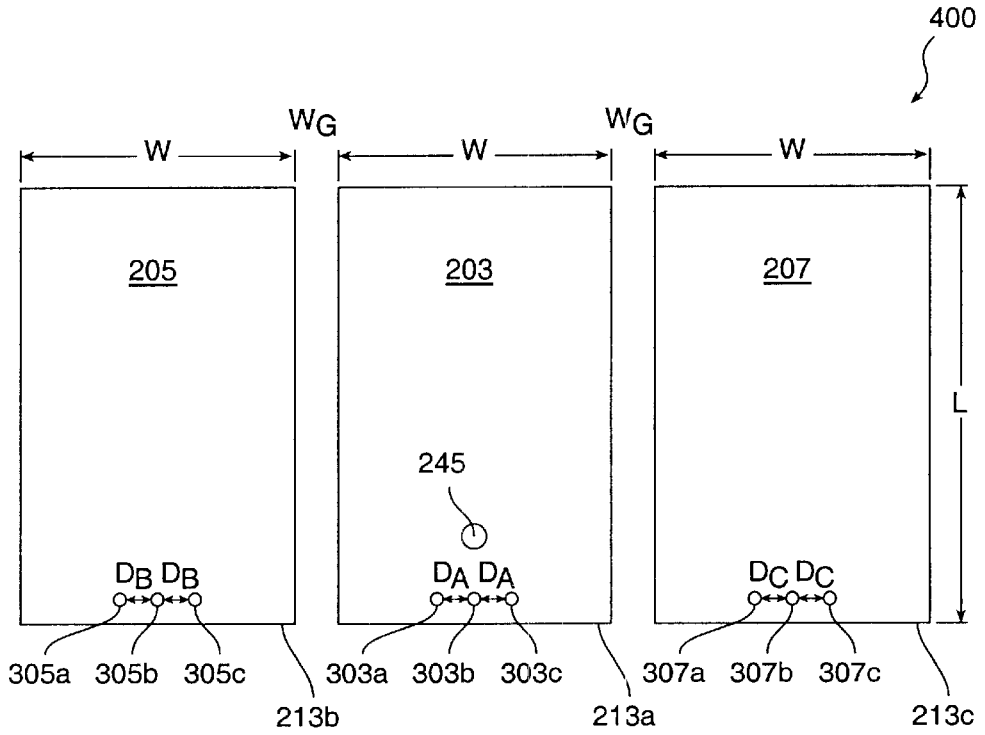
FIG. 4 is a top view of yet another embodiment of an antenna according to the invention.

FIG. 4 illustrates another embodiment of the invention in which shorting posts are used to create the partial short circuits. As shown, each antenna element 203, 205, and 207 includes a plurality of shorting posts 303*a–c,* 305*a–c,* and 307*a–c,* respectively. Although FIG. 4 illustrates three shorting posts per antenna element, it is within the scope of the invention to use more than, or less than, three shorting posts per element. It is also within the scope of the invention to use a different number of shorting posts on one or more of the antenna elements. The shorting posts 303*a–c,* 305*a–c,* and 307*a–c* are located proximate to the shorted edges 213*a,* 213*b,* and 213*c,* respectively, and are spaced along the width of each antenna element. In the embodiment, each shorting post has a radius R, and the shorting posts on the antenna elements 203, 205, and 207 are spaced apart by distances $D_A$, $D_B$, and $D_C$, respectively. Additionally, middle shorting posts 303*b,* 305*b,* and 307*b* are located substantially at the midpoint between side edges 243*a* and 245*a,* 243*b* and 245*b,* and 243*c* and 245*c,* respectively. However, it is within the scope of the invention to use different radii for one or more of the shorting posts, and to space shorting posts apart on an antenna element with different distances. Each of the holes for the shorting posts may be formed by techniques well known to those skilled in the art, such as drilling, boring, and the like. In a specific embodiment, the holes may then be filled with conductive material so that the antenna elements 203, 205, and 207 are each electrically connected to the ground plane 219. In other embodiments, the posts may be performed from conductive material and press fitted into the holes.

It has been found that when shorting posts are used instead of a complete short circuit, a series inductance L and a shunt capacitance C are added to each antenna element. The values of both L and C depend on the number of shorting posts, their radii R, the distance between their centers D, the thickness t of the antenna, and the permittivity $\epsilon$ and the permiability $\mu$ of the dielectric layer 231 of the antenna 300. In general, as D/2R increases, L increases while C decreases. Both C and L increase as t increases. The resulting reactance of the shorting posts will be either inductive or capacitive, depending upon the values of L and C. Thus, the resonant frequency of an antenna element will decrease if the reactance of its shorting posts is inductive, while capacitive reactance will increase the frequency.

Figure 5:
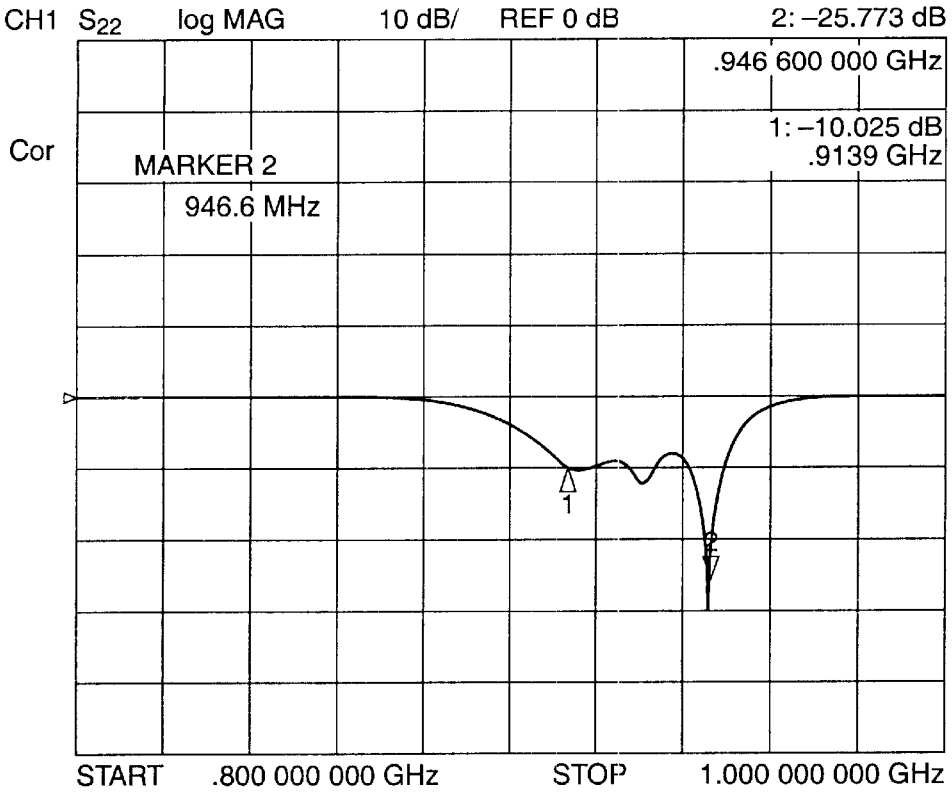
FIG. 5 is a graph that illustrates the return-loss of an exemplary embodiment.

Table 1 lists the dimensions of an antenna according to a specific embodiment of the invention in which three shorting posts per element were used. Distances from the feedpoint 245 and the shorting posts are measured from their respective center points. FIG. 5 illustrates the return loss of this specific embodiment.

TABLE 1

| Dimension | Symbol | Value |
|---|---|---|
| Length of Antenna Elements | L | 44 mm |
| Width of Antenna Elements | W | 17 mm |
| Thickness of Dielectric Layer | t | 3 mm |
| Width of Gap Between Antenna Elements | $W_G$ | 3 mm |
| Distance of Feedpoint from Shorted Edge | | 6 mm |
| Number of Shorting Posts per Antenna Element | | 3 |
| Distance of Shorting Posts from Shorted Edge | | 0.5 mm |
| Radius of the Shorting Posts | R | 0.375 mm |
| Distance Between Shorting Posts on Element 203 | $D_A$ | 2.9 mm |
| Distance Between Shorting Posts on Element 205 | $D_B$ | 3.1 mm |
| Distance Between Shorting Posts on Element 207 | $D_C$ | 3.9 mm |

Figure 6:
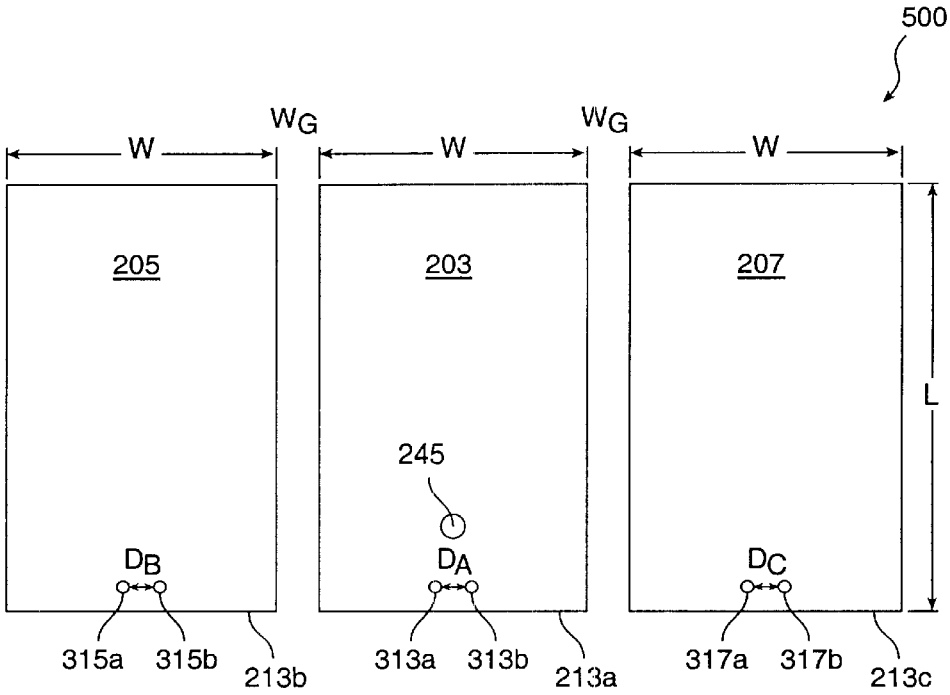
FIG. 6 is top view of still another embodiment of an antenna according to the invention.

FIG. 6 illustrates another embodiment of the invention in which two shorting posts per antenna element are used to create the partial short circuits. As shown, each antenna element 203, 205, and 207 includes two shorting posts 313*a* and 313*b,* 315*a* and 315*b,* and 317*a* and 317*c,* respectively. The shorting posts 313*a* and 313*b,* 315*a* and 315*b,* and 317*a* and 317*c* are located proximate to the shorted edges 213*a,* 213*b,* and 213*c,* respectively, and are spaced symmetrically along the width of each antenna element. In the embodiment, each shorting post has a radius R, and the shorting posts on the antenna elements 203, 205, and 207 are spaced apart by distances $D_A$, $D_B$, and $D_C$, respectively. However, it is within the scope of the invention to use different radii for one or more of the shorting posts, and to locate shorting posts on an antenna element with asymmetrically.

Figure 7:
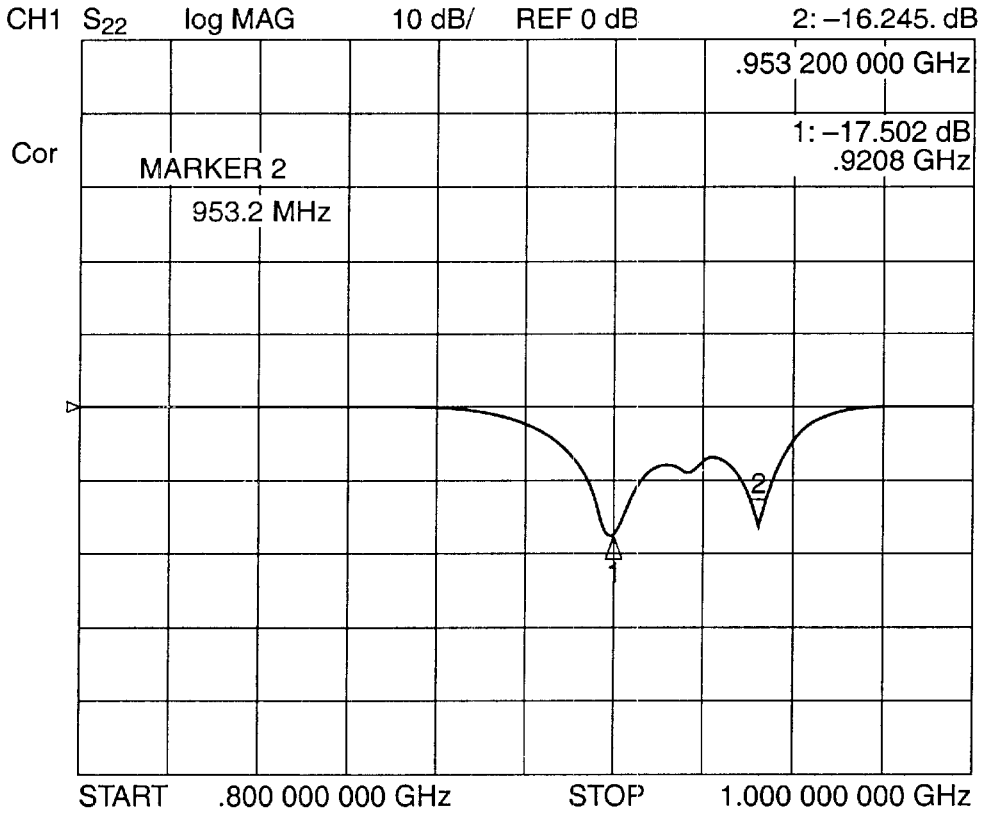
FIG. 7 is a graph that illustrates the return-loss of another exemplary embodiment.

Table 2 lists the dimensions of an antenna according to a specific embodiment of the invention in which two shorting posts per element were used. Distances from the feedpoint 245 and the shorting posts are measured from their respective center points. FIG. 7 illustrates the return loss of this specific embodiment.

TABLE 2

| Dimension | Symbol | Value |
|---|---|---|
| Length of Antenna Elements | L | 44 mm |
| Width of Antenna Elements | W | 17 mm |
| Thickness of Dielectric Layer | t | 3 mm |
| Width of Gap Between Antenna Elements | $W_G$ | 3 mm |
| Distance of Feedpoint from Shorted Edge | | 4 mm |
| Number of Shorting Posts per Antenna Element | | 2 |
| Distance of Shorting Posts from Shorted Edge | | 0.5 mm |
| Radius of the Shorting Posts | R | 0.25 mm |
| Distance Between Shorting Posts on Element 203 | $D_A$ | 5 mm |
| Distance Between Shorting Posts on Element 205 | $D_B$ | 5.4 mm |
| Distance Between Shorting Posts on Element 207 | $D_C$ | 6.8 mm |

Figure 8:
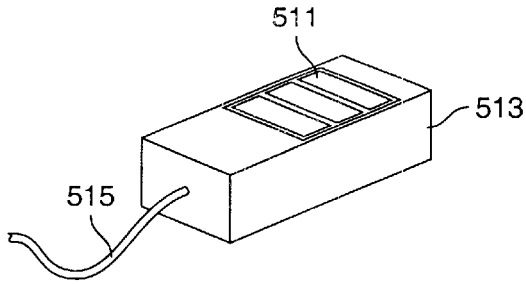
FIG. 8 is a simplified illustration of a mounting of an antenna according to the invention.
Figure 9:
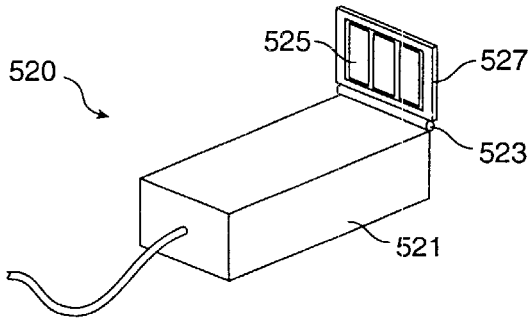
FIG. 9 is a simplified illustration of a mounting of an antenna according to the invention.

FIGS. 8 and 9 illustrate exemplary mounting schemes for a wideband microstrip antenna according to the invention. Other mounting schemes and antenna orientations will become obvious to those skilled in the art. It should be realized when viewing FIGS. 8 and 9 that the position of the wideband microstrip antenna is shown for illustrative purposes, and that, in practice, the wideband microstrip antenna will not typically be visible to a user. FIG. 8 illustrates a wideband microstrip antenna 511 mounted within a casing of a wireless modem 513. The wireless modem 513 may be coupled to, for example, a laptop computer via a cable 515. FIG. 9 illustrates a wireless modem 520 comprising a body 521, a moveable hinge 523, and a wideband microstrip antenna 525 mounted within a casing 527. The casing 527 is moveably coupled to the body 521 via hinge 523. In this embodiment, the orientation of the antenna 525 may be adjusted, using the hinge 523, to achieve better reception and/or to store or transport the wireless modem. Many other variations, modifications, and equivalents become obvious to one of ordinary skill in the art. For example, a wideband microstrip antenna may be incorporate within, or coupled with, a Personal Computer Memory Card International Association (PCMCIA) card, or the like. Additionally, a wideband microstrip antenna may be incorporated within a display casing of a laptop computer, or within a casing that may removably couple with a display casing of a laptop computer. Moreover, a wideband microstrip antenna may be incorporated within a casing of, or within a cover of, a personal digital assistant, pager, cellular phone, or the like.

The invention has now been explained with reference to specific embodiments. Other embodiments will be apparent to those of ordinary skill in the art. Therefore it is not intended that this invention be limited except as indicated by the appended claims.

What is claimed is:

1. An antenna structure, comprising:

a ground plane;

a layer of dielectric material having a first surface overlying said ground plane and an opposing second surface;

an electrically conductive layer overlying said second opposing surface of said dielectric layer, said electrically conductive layer being differentiated into a plurality of antenna elements including a driven antenna element and first and second non-driven, parasitic antenna elements, each of said driven and first and second non-driven elements having a shape of a parallelogram having parallel first edges of length L and parallel second edges of length W, wherein one of said first edges of said first parasitic element is disposed substantially along one of said first edges of said driven element at a gap width $W_G$, and wherein one of said first edges of said second parasitic element is disposed substantially along the opposite one of said first edges of said driven element at said gap width $W_G$;

each of said driven and first and second non-driven antenna elements including respective means for shorting said electrically conductive layer to said ground plane at a region proximate to one of said second edges of said electrically conductive layer;

each of said driven and first and second non-driven antenna elements having a respective resonant frequency, wherein said respective resonant frequency of said each of said driven and first and second non-driven antenna elements is varied from said resonant frequencies of other of said driven and first and second non-driven antenna elements using only characteristics of said respective means for shorting;

means for coupling radio frequency energy to said driven antenna element of said electrically conductive layer.

2. The antenna structure as in claim 1, wherein each of said respective shorting means is a partial short circuit having a respective width.

3. The antenna structure as in claim 2, wherein at least one of said partial short circuits comprises two segments.

4. The antenna structure as in claim 2, wherein said partial short circuit of said driven element has a first width, wherein said partial short circuit of said first parasitic element has a second width, and wherein said partial short circuit of said second parasitic element has a third width.

5. The antenna structure as in claim 1, wherein each of said respective shorting means is a plurality of shorting posts, and wherein each of said shorting posts are positioned a distance from at least another of said shorting posts.

6. The antenna structure as in claim 5, wherein each respective shorting means includes two shorting posts.

7. The antenna structure as in claim 5, wherein each respective shorting means includes three shorting posts.

8. The antenna structure as in claim 5, wherein for each of said driven and first and second non-driven antenna elements, a number of shorting posts and said distances are selected to achieve a resonant frequency for said each of said driven and first and second non-driven antenna elements.

9. The antenna structure as in claim 1, wherein each of said respective shorting means is a electrically conductive tape having a width.

10. The antenna structure as in claim 9, wherein said tape of said driven element has a first width, wherein said tape of said first parasitic element has a second width, and wherein said tape of said second parasitic element has a third width.

11. The antenna structure as in claim 1, wherein said antenna structure conforms to a casing in which a wireless modem is mounted.

12. The antenna structure as in claim 11, wherein said casing comprises a shell of a wireless modem.

13. The antenna structure as in claim 11, wherein said casing comprises a shell of a PCMCIA card.

14. The antenna structure as in claim 1, wherein said antenna structure conforms to a casing, said casing movably coupled with a base of a wireless modem.

15. The antenna structure as in claim 14, wherein said base is a PCMCIA card.

16. The antenna structure as in claim 14, wherein said casing is removably coupled to a computer display.

17. A microstrip antenna comprising:

a ground plane;

an electrically conductive layer positioned parallel to, and coextensive with, said ground plane;

a dielectric layer positioned between said ground plane and said electrically conductive layer;

wherein said electrically conductive layer is differentiated into a plurality of antenna elements including a driven antenna element and first and second non-driven, parasitic antenna elements, said driven and first and second parasitic elements each having a substantially rectangular shape and each having first and second parallel side edges of a length and a base edge of a width, wherein one of said side edges of said first parasitic element is disposed along and parallel with said first side edge of said driven element at a gap width, and wherein one of said side edges of said second parasitic element is disposed along and parallel with said second side edge of said driven element at said gap width;

wherein said widths of said base edges are substantially the same, and wherein said gap widths are substantially the same;

respective shorting means positioned proximate to said base edge of each of said driven and said first and second parasitic antenna elements for shorting said electrically conductive layer to said ground plane;

each of said driven and said first and second parasitic antenna elements having a respective resonant frequency, wherein said respective resonant frequency of said each of said driven and first and second non-driven antenna elements is varied from said resonant frequencies of other of said driven and first and second non-driven antenna elements using only characteristics of said respective means for shorting; and means for coupling radio frequency energy to said driven antenna element of said electrically conductive layer.

18. The microstrip antenna as in claim 17, wherein each of said respective shorting means is a partial short circuit having a respective width.

19. The microstrip antenna as in claim 18, wherein at least one of said partial short circuits comprises two segments.

20. The microstrip antenna as in claim 18, wherein said partial short circuit of said driven element has a first width, wherein said partial short circuit of said first parasitic element has a second width, and wherein said partial short circuit of said second parasitic element has a third width.

21. The microstrip antenna as in claim 17, wherein each of said respective shorting means is a plurality of shorting posts, and wherein each of said shorting posts are positioned a distance from at least another of said shorting posts.

22. The microstrip antenna as in claim 21, wherein each respective shorting means includes two shorting posts.

23. The microstrip antenna as in claim 21, wherein each respective shorting means includes three shorting posts.

24. The microstrip antenna as in claim 21, wherein for each of said driven and first and second parasitic antenna elements, a number of shorting posts and said distances are selected to achieve a resonant frequency for said each of said driven and first and second parasitic antenna elements.

25. The microstrip antenna as in claim 17, wherein each of said respective shorting means is a electrically conductive tape having a respective width.

26. The microstrip antenna as in claim 25, wherein said tape of said driven element has a first width, wherein said tape of said first parasitic element has a second width, and wherein said tape of said second parasitic element has a third width.

27. The microstrip antenna as in claim 17, wherein said antenna structure conforms to a casing in which a wireless modem is mounted.

28. The microstrip antenna as in claim 27, wherein said casing comprises a shell of a wireless modem.

29. The microstrip antenna as in claim 27, wherein said casing comprises a shell of a PCMCIA card.

30. The microstrip antenna as in claim 17, wherein said antenna structure conforms to a casing, said casing movably coupled with a base of a wireless modem.

31. The microstrip antenna as in claim 30, wherein said base is a PCMCIA card.

32. The microstrip antenna as in claim 30, wherein said casing is removably coupled to a computer display.

* * * * *